US006970661B2

(12) United States Patent
Shoji

(10) Patent No.: US 6,970,661 B2
(45) Date of Patent: Nov. 29, 2005

(54) IMAGE FORMING APPARATUS, CARTRIDGE, IMAGE FORMATION SYSTEM, AND STORAGE MEDIUM FOR CARTRIDGE

(75) Inventor: Takeo Shoji, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 61 days.

(21) Appl. No.: 10/702,613

(22) Filed: Nov. 7, 2003

(65) Prior Publication Data

US 2004/0136740 A1 Jul. 15, 2004

(30) Foreign Application Priority Data

Nov. 8, 2002 (JP) ..... 2002-325796
Oct. 30, 2003 (JP) ..... 2003-370553

(51) Int. Cl.[7] ..... G03G 15/02
(52) U.S. Cl. ..... 399/50
(58) Field of Search ..... 399/46, 48, 50, 399/66, 168, 174, 176, 297, 307, 310, 313

(56) References Cited

U.S. PATENT DOCUMENTS

| | | | | |
|---|---|---|---|---|
| 5,095,335 | A | 3/1992 | Watanabe et al. | 355/210 |
| 5,272,503 | A | 12/1993 | LeSueur et al. | 355/208 |
| 5,331,372 | A | 7/1994 | Tsuda et al. | 355/200 |
| 5,455,665 | A | 10/1995 | Baba et al. | 355/298 |
| 5,470,635 | A | 11/1995 | Shirai et al. | 428/131 |
| 5,565,961 | A | 10/1996 | Shoji et al. | 355/200 |
| 5,608,509 | A | 3/1997 | Shirai et al. | 355/351 |
| 5,626,997 | A | 5/1997 | Mashimo et al. | 430/55 |
| 5,828,928 | A | 10/1998 | Sasago et al. | 399/111 |
| 5,835,818 | A | 11/1998 | Hoshika et al. | 399/26 |
| 5,884,124 | A | 3/1999 | Karakama et al. | 399/123 |
| 6,253,044 | B1 | 6/2001 | Shoji et al. | 399/111 |
| 6,591,070 | B1 | 7/2003 | Shoji et al. | 399/27 |
| 6,615,002 | B2 * | 9/2003 | Saito et al. | 399/43 |
| 6,782,215 | B2 * | 8/2004 | Komori | 399/50 |
| 2002/0021908 | A1 | 2/2002 | Matsumoto et al. | 399/27 |
| 2003/0156869 | A1 | 8/2003 | Karakama et al. | 399/350 |

FOREIGN PATENT DOCUMENTS

| | | |
|---|---|---|
| JP | 7-244419 | 9/1995 |
| JP | 2001-117425 | 4/2001 |
| JP | 2001-117468 | 4/2001 |
| JP | 2001-281968 | 10/2001 |

* cited by examiner

*Primary Examiner*—Hoang Ngo
(74) *Attorney, Agent, or Firm*—Fitzpatrick, Cella, Harper & Scinto

(57) ABSTRACT

An image forming apparatus to which a process cartridge is detachably mountable, the process cartridge including an image bearing member, a charging member for electrically charging the image bearing member, and a memory medium having a memory area for storing information relating to a charging current for a non-image-formation period;

the apparatus including a control unit for switching a voltage to be applied to the charging member in accordance with the information stored in the memory medium.

17 Claims, 12 Drawing Sheets

IMAGE FORMING APPARATUS, CARTRIDGE, IMAGE FORMATION SYSTEM, AND STORAGE MEDIUM FOR CARTRIDGE

FIELD OF THE INVENTION AND RELATED ART

The present invention relates to: an image forming apparatus such as a laser beam printer, a copying machine, fascimileing machine, etc., which employs an electrophotographic image forming method; a process cartridge mountable in said image forming apparatus; an image formation system for forming an image on recording medium with the use of said process cartridge, and a storage medium mountable in said process cartridge.

Here, a process cartridge means a cartridge in which an electrophotographic photoconductive member, and a minimum of one processing means among a charging means, a developing means, and a cleaning means, are integrally disposed, and which is removably mountable in the main assembly of an image forming apparatus. It also means a cartridge in which a minimum of a charging means and an electrophotographic photoconductive member are integrally disposed, and which is removably mountable in the main assembly of an image forming apparatus.

In an electrophotographic image forming apparatus such as a copying machine or a laser beam printer, an image is formed through the following steps. That is, a beam of light is projected, while being modulated with image formation information, onto the electrophotographic photoconductive member, forming a latent image thereon, and the latent image is developed into a visual image by supplying the latent image with developer (toner) as recording material, by a developing means. Then, the visual image is transferred from the photoconductive member onto recording medium such as a piece of recording paper.

For the simplification of maintenance, more specifically, in order to make it easier to replace a photoconductive drum, or replenish an image forming apparatus with a consumable such as toner, some of the image forming apparatuses of the above described type are structured to be compatible with a process cartridge, in which the combination of a toner storage and a developing means, a photoconductive member, a charging means, and a cleaning means inclusive of a waste toner storage (container), etc., are integrally disposed, and which is removably mountable in the main assembly of an image forming apparatus.

In the case of such an image forming apparatus as a color image forming apparatus having a plurality of developing means, each developing means may be different in the rate of wear from the other, and in addition, the rates at which the photoconductive drums wear may be different from the rates at which the developing means wear. Thus, as a means for dealing with these problems, various process cartridges are created; for example, development cartridges, photoconductive drum cartridges, etc. In the case of the development cartridges, they are made different in the color in which they develop a latent image. In the case of the photoconductive drum cartridges, they comprise the combination of a cleaning means and a photoconductive drum.

Further, some process cartridges are provided with a storage means (memory) in order to manage the information regarding them. For example, in the case of a process cartridge disclosed in U.S. Pat. No. 5,272,503, the amount of the cumulative cartridge usage is stored in the memory to alter the operational setting according to the amount of the cumulative cartridge usage; the amount of charge current is switched, or the amount of exposure light is adjusted. In the case of these process cartridges, they are controlled in the same manner, despite their differences, as long as they are the same in the amount of cumulative usage.

In the case of Japanese Laid-open Patent Application 2001-117425 or 2001-117468, in order to extend the service life of the photoconductive drum of each process cartridge, the amount of the charge current to flow in the process cartridge is switched according to the properties of the cartridge and the information stored in the storage medium of the cartridge; the amount of the charge current is switched to the minimum value necessary to keep image quality at a preferable level.

Incidentally, there are other methods for extending the service life of a photoconductive member. For example, a photoconductive member may increased in the thickness of its surface layer, which is reduced at a constant rate, or a harder substance may be used as the material for the surface layer, while keeping the photoconductive drum the same in the thickness of the surface layer.

Further, the amount of the wear of a photoconductive drum can be reduced by modifying the charging sequence so that the charge voltage is not applied during the so-called sheet interval, that is, the interval between a sheet of recording medium and the following sheet of recording medium, that is, the interval between the process for forming an image on a sheet of recording medium and the process for forming an image on the following sheet of recording medium (Japanese Laid-open Patent Application 7-244419, etc.).

However, in the case of the above described conventional method in which a harder substance is used as the means for extending the service life of a photoconductive drum, a new substance must be developed from scratch, and evaluated. Therefore, this method requires a substantial length of time. In addition, if a harder substance is used as the material for the surface layer of a photoconductive drum, the surface layer of the photoconductive drum is less likely to be shaved away. Therefore, the unwanted substances, more specifically, the by-products of the electrical discharge resulting from the charging of the photoconductive drum, having adhered to the surface layer are less likely to be shaved away. As a result, a defective image, which is defective in that it appears unfocused like an image of a body of flowing water, is sometimes produced. In comparison, the method in which a photoconductive drum is simply increased in the thickness of its surface layer, in anticipation of the shaving, has the following problems. That is, if the thickness by which the surface layer is coated on a photoconductive layer exceeds a certain value, the ratio at which exposure light is transmitted through the surface layer becomes insufficient; in other words, the photoconductive drum becomes inferior in sensitivity, more specifically, in dot reproducibility, failing thereby to reproduce a minute spot or the like, which in turn results in the formation of an image of lower quality.

The method in which charge voltage is not applied during a sheet interval is definitely effective to reduce the wear on a photoconductive drum. However, it has the following problem. That is, while charge voltage is not applied, the portion of the peripheral surface of the photoconductive drum, which passes through the charging station while the charge voltage is not applied, is reduced in potential level, becoming unstable in its potential level. As a result, developer (which hereinafter may be referred to as toner) of the normal type, or the reversal type, adheres to this portion of the peripheral surface of the photoconductive drum. Consequently, the interior of the image forming apparatus is soiled. Further, in the case of an image forming apparatus in which the transfer roller remains in contact with the peripheral surface of the photoconductive drum, the transfer roller is soiled by the toner having adhered to the above described portion of the peripheral surface of the photoconductive drum, which corresponds to a sheet interval, and then, soils the following sheet of recording medium.

SUMMARY OF THE INVENTION

The present invention is made to solve the above described problems, and its primary object is to provide a combination of an image forming apparatus and a process cartridge, capable of reducing the amount of the shaving of a photoconductive drum, an image formation system for forming an image on recording medium with the use of said combination of an image forming apparatus and a process cartridge, and memory mountable in the process cartridge, in said combination.

Another object of the present invention is to provide a combination of an image forming apparatus and a process cartridge, capable of reducing the amount of the shaving of a photoconductive drum while maintaining image quality at a preferable level, an image formation system for forming an image on recording medium with the use of said combination of an image forming apparatus and a process cartridge, and memory mountable in the process cartridge in said combination.

The above described objects of the present invention are accomplished by the combination of an image forming apparatus and a process cartridge, an image formation system for forming an image on recording medium with the use of the combination of an image forming apparatus and a process cartridge, and a memory mountable in the process cartridge in the combination.

The image forming apparatus in accordance with the present invention is an image forming apparatus in which a cartridge comprising an image bearing member and a charging member for charging the image bearing member is removably mountable, and which is characterized in that:

the cartridge is provided with a storage medium having a first storage region for storing the information regarding the charge current to flow during a non-image formation period, and the main assembly of the image forming apparatus is provided with a control unit for switching the voltage applied to the charging member, in accordance with the information in the storage medium.

The cartridge in accordance with the present invention is a cartridge which has an image bearing member and a charging member for charging the image bearing member and is removably mountable in an image forming member, and which is characterized in that:

it is provided with a storage medium for storing the information regarding the cartridge, and the storage medium has a first storage region for storing the information regarding the charge current to flow during a non-image formation period.

The storage medium in accordance with the present invention is a storage medium which is mounted in a cartridge having an image bearing member and a charging member for charging the image bearing member, and is characterized in that:

it has a first storage region for storing the information regarding the charge current to flow during a non-image formation period.

The image formation system in accordance with the present invention is an image formation system for an image forming apparatus comprising the main assembly and a process cartridge, which makes the main assembly of the image forming apparatus carry out a part of the image formation process, and is characterized in that:

it comprises a storage medium to be mounted in a cartridge;

the storage medium has a first storage region for storing the information regarding the charge current to flow during a non-image formation period; and it comprises a control unit which switches the amount of the voltage outputted to the charging member, in accordance with the information in the storage medium.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, process cartridges, image forming apparatuses in which a single or plurality of process cartridges are removably mountable, image formation systems employing a single or plurality of process cartridges, and memories mountable in a process cartridge, in accordance with the present invention, will be described in more detail with reference to the appended drawings.

Embodiment 1

Figure 1:
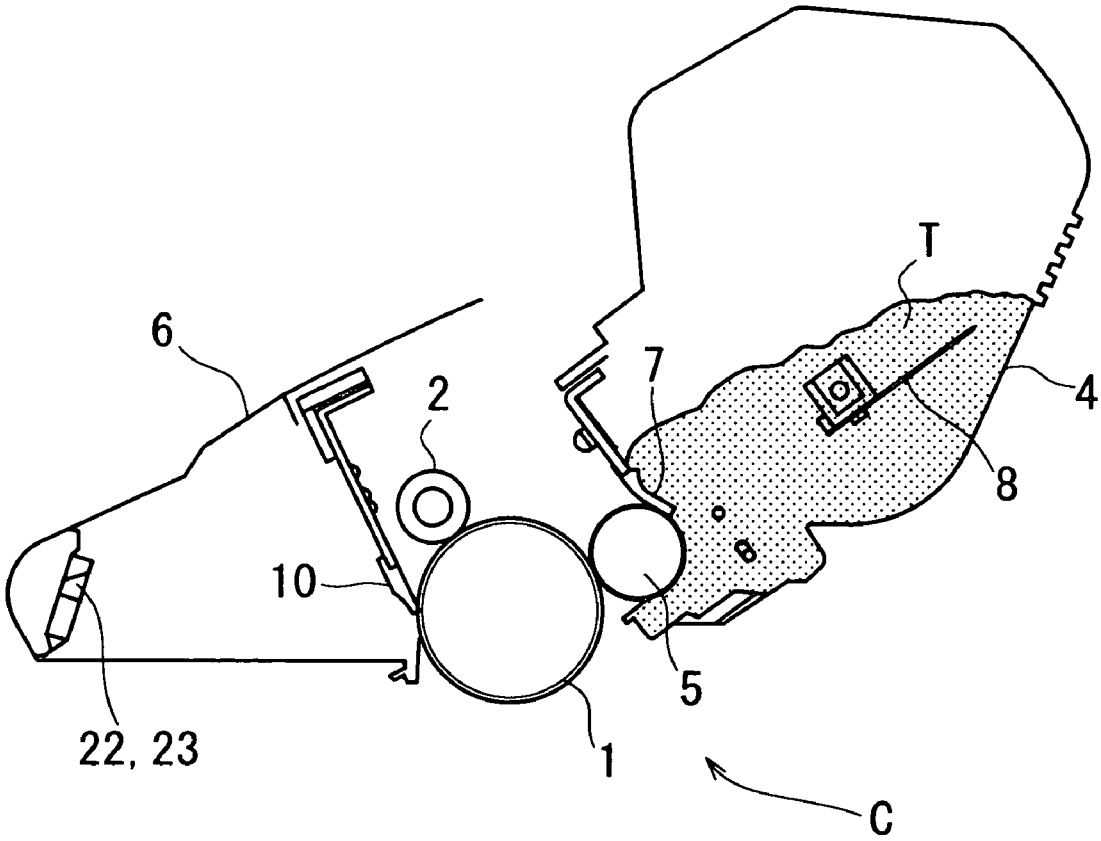
FIG. 1 is a sectional view of the process cartridge in the first embodiment of the present invention.

First, referring to FIGS. 1 and 2, an example of an electrophotographic image forming apparatus in which a process cartridge structured in accordance with the present invention is mountable will be described. The image forming apparatus in this embodiment is a laser beam printer which outputs an image by receiving image formation information from a host computer, and in which a process cartridge is removably mountable in order to replace the photoconductive member in the form of a drum, that is, a photoconductive drum, having expired in service life, with a brand-new one, or to replenish the image forming apparatus with consumables such as developer. First, the image forming apparatus and process cartridge in this embodiment will be described with reference to FIGS. 1 and 2.

The process cartridge C in this embodiment comprises a plurality of components as elements for carrying out the image formation process for the image forming apparatus in this embodiment. More specifically, the process cartridge C comprises: a housing (cartridge shell), and a plurality of processing means integrally disposed in the housing. The processing means are: a photoconductive drum 1, that is, a photoconductive member in the form of a drum; a contact type charging roller 2 for uniformly charging the photoconductive drum 1; a development sleeve 5 as a developing means disposed in parallel to the photoconductive drum 1 so that its peripheral surface is positioned virtually in contact with the peripheral surface of the photoconductive drum 1; and a cleaning blade 10 as a cleaning means; etc. The housing comprises: a developer storage portion (developer container) 4 which rotatably supports the development sleeve 5 and contains developer T; and a waste toner holding portion (waste toner container) 6 in which the residual toner is stored after it is removed from the photoconductive drum 1 by the cleaning blade 10. The process cartridge C is removably mountable in the mounting means 101, shown in FIG. 2, of an image forming apparatus, by a user.

The development sleeve 5 of the developing means is a nonmagnetic sleeve with a diameter of 20 mm. It comprises an aluminum cylinder, and a resinous layer formed on the peripheral surface of the aluminum cylinder by coating on the peripheral surface of the aluminum cylinder a resinous material which contains electrically conductive particles. In the hollow of the development sleeve 5, a magnetic roll with four magnetic poles is disposed, although it is not shown. The developer regulating member in this embodiment is a piece of urethane rubber with a hardness of 68° (JIS), and is kept in contact with the development sleeve 5 so that the contact pressure between the developer regulating member and development sleeve 5 remains in the range of 30–40 gf/cm (contact pressure per 1 cm in terms of lengthwise direction of development sleeve 5).

In this embodiment, the developer T stored in the developer storage portion (container) 4 is a single-component magnetic toner negative in inherent electrical polarity (which hereinafter will be simply referred to as toner). The ingredients of the toner are bonding resin, which is copolymer of styrene n-butyl acrylate (100 parts in weight), magnetic particles (80 parts in weight), negative charge controlling agent (2 parts in weight), which is monoazoic iron complex, and wax (3 parts in weight), which is polypropylene with a small molecular weight. In production, these ingredients are melted and kneaded in the biaxial extruder heated to 140° C., and cooled. Then, the cooled mixture is pulverized with a hammer mill. The pulverized mixture is further reduced in particle size with a jet mill. Then, the resultant product is sorted with air flow, obtaining such developer that is 5.0 μm in weight average diameter. Then, the developer with a weight average diameter of 5.0 μm is mixed with 1.0 parts in weight of silica, that is, a hydrophobic substance, in the form of minute particles, with the use of a Henschell mixer, obtaining the developer T in accordance with the present invention. The weight average particle diameter of the developer T is in the range of 3.5–7.0 μm (roughly 6 μm).

When the gap between the photoconductive drum 1 and development sleeve 5 is, for example, roughly 300 μm, the development bias applied to the development sleeve 5 is the combination of a DC voltage of −450 V, and an AC voltage which is rectangular in waveform, 1,600 V in peak-to-peak voltage, and 2,400 Hz in frequency.

There is a toner stirring means 8 in the developer storage portion, that is, the toner container 4. The toner stirring means 8 rotates once every six seconds, sending toner into the development range while loosening the toner T in the toner container 4.

The charge roller 2 comprises a metallic core, and a layer of electrically conductive elastic material formed on the peripheral surface of the metallic core. It is rotatably supported by the lengthwise end portions of the metallic core, being kept in contact with the peripheral surface of the photoconductive drum 1 so that a predetermined amount of contact pressure is maintained between the peripheral surface of the photoconductive drum 1 and charge roller 2. It is rotated by the rotation of the photoconductive drum 1. To the charge roller 2, the combination (Vac+Vdc) of an AC component Vac and a DC component Vdc is applied from the high voltage power source in an image forming apparatus 100, through the metallic core. As the result, the peripheral surface of the photoconductive drum 1, which is being rotationally driven, is uniformly charged by the charge roller 2 which is in contact with the photoconductive drum 1. In terms of peak-to-peak voltage, the AC component Vac is twice the threshold voltage for charging the photoconductive drum 1.

More specifically, the charge bias applied to the charge roller 2 is the combination of a DC voltage of −620 V, and an AC voltage which is rectangular in waveform, 2 kV in peak-to-peak voltage, 1,800 Hz in frequency, and 1,600 μA in effective current value. As a result, the peripheral surface of the photoconductive drum 1 is charged to a potential level Vd of −600 V. As a given point of the charged portion of the peripheral surface of the photoconductive drum 1 is exposed to a beam of laser light for exposure, the potential level VL of this point reduced to −150V, and this point (with potential level of VL) is developed in reverse.

Figure 2:
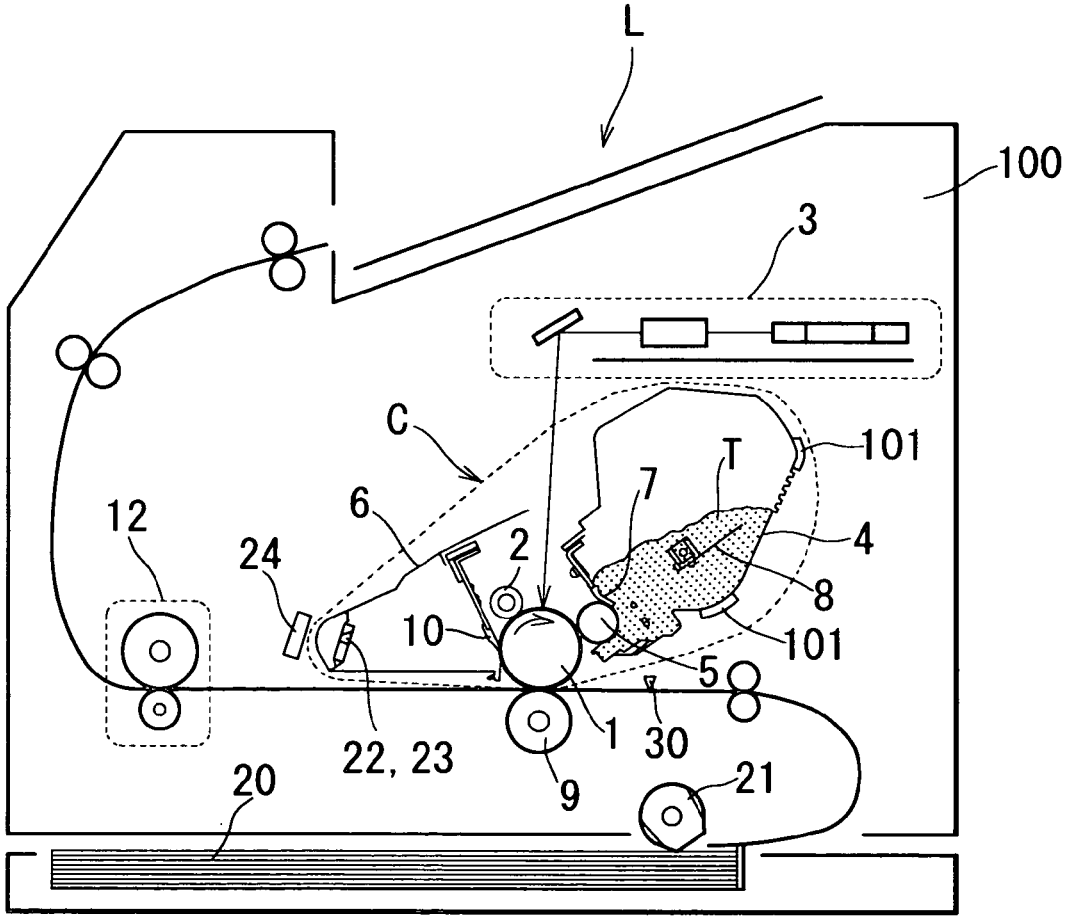
FIG. 2 is a sectional view of the image forming apparatus in the first embodiment of the present invention.

The general structure of the image forming apparatus, or a laser beam printer L, in this embodiment is shown in FIG. 2. The cylindrical photoconductive drum 1 as a member for bearing a latent image is rotated about its axle supported by the main assembly of the image forming apparatus 100, in the direction indicated by an arrow mark. After a given portion of the peripheral surface of the photoconductive drum 1 is uniformly charged by the charge roller 2, a latent image is formed on this portion by an exposing apparatus 3. Then, this portion of the peripheral surface of the photoconductive drum 1, across which the latent image having just been formed is supplied with the developer T, by the development sleeve 5 which is an essential part of the developing apparatus. As a result, the latent image is developed into a visible image. The development sleeve 5 is connected to a bias supplying power source (unshown) which applies the combination of a DC bias and an AC bias between the photoconductive drum 1 and development sleeve 5, so that a proper development bias is applied between the photoconductive drum 1 and development sleeve 5.

The toner image on the photoconductive drum 1, that is, the image formed on the photoconductive drum 1 by visualizing the latent image with the use of the toner T through the above described steps, is transferred onto a recording medium 20, for example, a piece of recording paper, by a transfer roller 9. The recording medium 20 is fed into the main assembly of the image forming apparatus 100 by a feed roller 21, and is sent to the transfer roller 9 while its movement is synchronized with that of the toner image on the photoconductive drum 1 by a registration roller (unshown) and a top sensor 30. Then, the toner image, or an image formed of the toner T, is transferred onto the recording medium 20, and is sent, together with the recording medium 2, to a fixing apparatus 12. In the fixing apparatus 12, the toner image on the recording medium 2 is fixed to the recording medium 20 with the application of heat and/or pressure, turning into a permanent image. Thereafter, the recording medium 20, which at this point is bearing the permanent toner image is discharged out of the main assembly of the image forming apparatus 100. The next recording medium 20 is fed into the main assembly of the image forming apparatus 100 with a predetermined timing, that is, a predetermined length of time after the passage of the preceding recording medium 20 by the top sensor 30 (after the scheduled ending of the formation of an image on the preceding recording medium 20). Meanwhile the portion of the toner T which remained on the photoconductive drum 1, that is, the portion of the toner T, which was not transferred, is removed by a cleaning blade 10, and is stored in the waste toner container 6. Thereafter, the portion of the peripheral surface of the photoconductive drum 1, from which the residual portion of the toner T has been removed, is charged again by the charging apparatus 2, and is subjected again to the above described steps.

Next, the storage medium, that is, the memory, for a process cartridge mountable in the above described process cartridge, will be described.

In the case of this embodiment, the cartridge C is provided with a memory 22, and a transmitting portion 23 for controlling the process of reading the information in the memory 22 and the process of writing information into the memory 22. The memory 22 and transmitting portion 23 are on the bottom portion of the inward surface of the waste toner container 6, so that when the cartridge C is in the proper position in the main assembly of the image forming apparatus 100, the transmitting portion 23 of the cartridge C opposes the control portion 24 of the main assembly of the image forming apparatus 100. The control portion 24 of the main assembly is to have the function of transmitting means, in addition to the controlling function.

As for the choice of the storage medium usable as the memory 22 in this embodiment, any of the ordinary electronic memories based on semiconductor can be used with no specific restriction. When a noncontact type memory, that is, a memory which uses electromagnetic waves for the data communication (reading or writing) between the memory and the reading/writing IC, is employed as the memory 22, there is no need for actual contact between the transmitting portion 23 of the cartridge C and the control portion of the apparatus main assembly, virtually eliminating the possibility that the data communication between the memory 22 and the reading/writing IC will fail because of the positional state of the cartridge C in the main assembly, and therefore, assuring the data communication between the memory 22 and control portion 24.

These two portions, that is, the control portion 24 and transmitting portion 23 constitute the means for controlling the processes of reading the information in the memory 22 and writing information into the memory 22. The capacity of the memory 22 is to be sufficient to store multiple sets of information, for example, the information regarding the identity of the cartridge C (which will be described later), the numerical values of the cartridge properties, etc.

In this embodiment, the amount of the usage of the cartridge C is written into the memory 22, and stored therein, each time the cartridge C is used. There is no specific restriction regarding the terms in which the amount of cartridge usage is measured. In other words, the terms in which the amount of cartridge usage is measured is optional, as long as the amount of cartridge usage can be determined by the image forming apparatus. For example, it may be the length of time a given unit in the cartridge has been rotated, the length of time bias has been applied to a given unit in the cartridge, the amount of the remaining toner, the number of produced prints, the number of dots formed on the photoconductive drum 1 for image formation, the cumulative length of time the laser of the exposing means is fired for the exposure of the photoconductive drum 1, the thickness of the photoconductive layer of the photoconductive drum 1, etc. Further, these factors may be employed in weighted combination.

Prior to the shipment of each process cartridge from, for example, a factory, various values are assigned to each process cartridge to show the properties of the cartridge. These values are the parameters, based on which processing settings are adjusted. As for the types of cartridge properties to which a specific value is assigned, there are production lot numbers for the photoconductive drum 1, toner T, development sleeve 5, or charge roller 2, the sensitivity of the photoconductive drum 1, the thresholds and coefficients of the arithmetic formulae weighted in accordance with the length of time the charge bias has been applied and the length of time the photoconductive drum 1 has been driven, etc.

The processing settings are controlled based on the relationship between the above described set of values, and the sets of information in the memory 22. That is, calculation is made by the transmitting portion 23 of the cartridge and the control portion 24 of the main assembly, using the information in the memory 22, and based on the results of the calculation, various signals are sent to each processing unit, to adjust the output of the high voltage power source, processing speed, amount of laser light, etc.

Next, the controlling of the settings for image formation process, in this embodiment, will be described.

In this embodiment, the charge roller 2 as a charging means is used in combination with a charging method in which an AC voltage is applied, in addition to a DC voltage, to the charging means. Therefore, positive and negative voltages are alternately applied to the charge roller 2, causing electrical discharge to alternately occur in one direction and the reverse direction. The deterioration of the peripheral surface of the photoconductive drum 1, as the member to be charged, which is caused by this electrical discharge is substantial, and the deteriorated portions of the peripheral surface of the photoconductive drum 1 are shaved away by the friction between the photoconductive drum 1 and the members, such as the cleaning blade 10, which are in contact with the photoconductive drum 1.

Thus, as the image forming apparatus is used, the photoconductive layer of the photoconductive drum 1 gradually is reduced in thickness. As the thickness of the photoconductive layer of the photoconductive drum 1 is reduced to a certain value (critical value: threshold value), the photoconductive layer becomes insufficient in photoconductivity. As a result, the photoconductive layer of the photoconductive drum 1 is reduced in charging retention capability. Consequently, it is improperly charged; for example, it becomes non-uniformly charged. Thus, the length of the service life of an image forming apparatus, and that of a process cartridge, can be defined as the number of prints which can be produced before the thickness of the photoconductive layer of the photoconductive drum 1 is reduced below the critical value (threshold).

It has been known, on the other hand, that if the amount of the electrical discharge is reduced to a certain value, an image, which has the so-called sands, that is, an area covered with minute black spots, is formed. In other words, it has been known that when the amount of the electrical discharge is reduced below a certain value, the electrical discharge is likely to become unstable. Incidentally, the "sands" means an area of an image covered with the unwanted black spots, the location of which correspond to the portions of the peripheral surface of the photoconductive drum 1, which was insufficiently charged because the amount of the electrical discharge between the charge roller 2 and photoconductive drum 1 was smaller than a certain value. It has been known that an image suffering from the above described "sands" is more frequently formed, and the "sands" is more conspicuous, when the peak-to-peak voltage of the oscillatory voltage applied to the charge roller 2 is smaller than a certain value.

Thus, in order to extend the service lives of an image forming apparatus and a process cartridge while maintaining image quality at a preferable level, it is necessary to employ a photoconductive drum having a photoconductive layer thick enough for the photoconductive layer to be able to keep a latent image sharp; to prevent the formation of the "sands" traceable to an excessively small amount of electrical discharge between a charge roller and a photoconductive drum; and to adjust the amount of the electrical discharge to a proper value for reducing the amount of the deterioration of a photoconductive member.

As for the method for controlling the voltage applied to a contact type charging member such as the charge roller 2, one of the conventional current controlling methods in which the amount of the current which flows from the charge roller 2 to photoconductive drum 1 is kept constant is used.

The following are the results of the experiments carried out to study the relationship between the amount by which a photoconductive drum 1 was shaved, and the total amount of the charge current which flowed from a charge roller 2 to the photoconductive drum 1.

Figure 3:
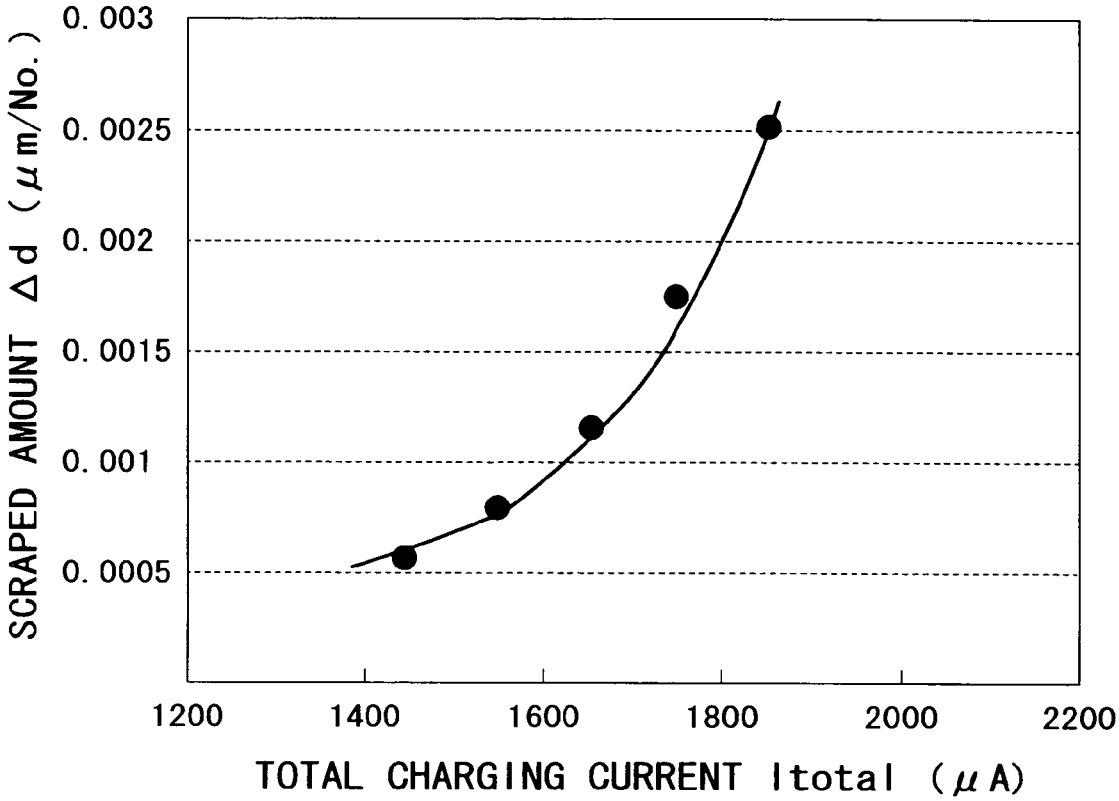
FIG. 3 is a graph showing the relationship between the total amount of the charge current and the amount by which the photoconductive member is shaved, in the first embodiment of the present invention.

FIG. 3 shows the relationship between the amount d ($\mu$m/print) by which a photoconductive member was shaved, and the total amount of the charge current $l_{total}$. It is evident from FIG. 3 that the smaller the total amount of the charge current $l_{total}$, the smaller the amount by which the photoconductive drum 1 is shaved. For example, when the total amount of the charge current was 1,600 $\mu$A, the amount by which the photoconductive drum 1 was shaved per print was 0.0009 $\mu$m. However, the amount by which the photoconductive drum 1 was shaved per print was reduced from 0.0009 $\mu$m to 0.00055 $\mu$m, by reducing the total amount of the charge current from 1,600 $\mu$A to 1,400 $\mu$A.

Incidentally, the values of the thickness d of the photoconductive layer, in the graphs, are values obtained by actually measuring the photoconductive layers with the use of a film thickness measuring device (Permascope E-111, Fischer Co., Ltd.).

Next, referring to FIGS. 4 and 5, the setup for controlling the memory 22, in this embodiment, will be described.

Figure 4:
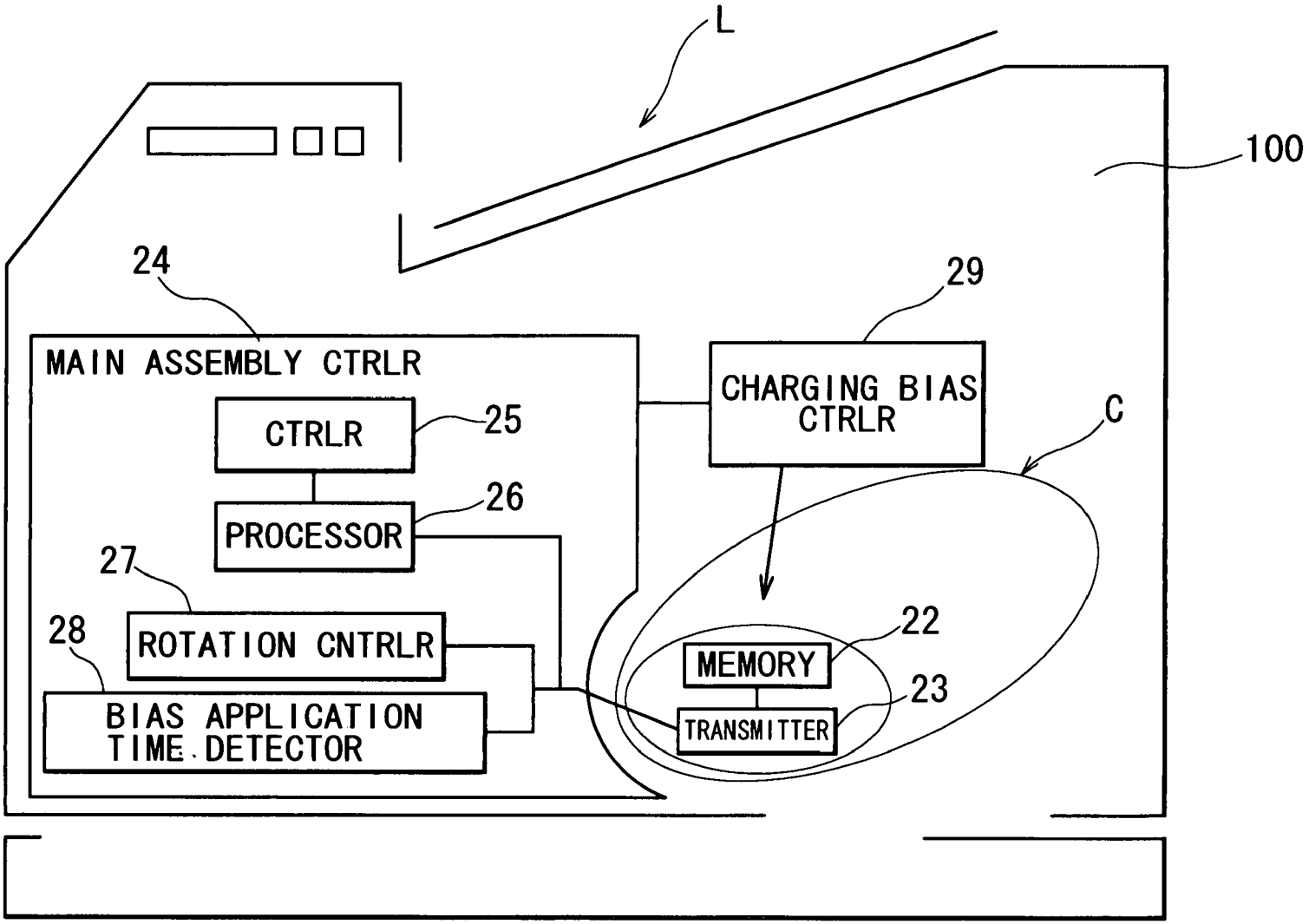
FIG. 4 is a block diagram showing the control portion of the main assembly of the image forming apparatus, and the memory of the process cartridge, in the first embodiment of the present invention.

Referring to FIG. 4, the cartridge C is provided with the memory 22 and transmitting portion 23, whereas the main assembly of the image forming apparatus is provided with the control portion (unit) 24. The control unit 24 on the main assembly side comprises: controlling portion proper 25, an arithmetic portion 26, a photoconductive member rotation controlling portion 27, a detecting portion 28 for detecting the length in time of the application of the charge bias, a charge bias power source 29 for applying bias to the charge roller of the cartridge, etc.

Figure 5:
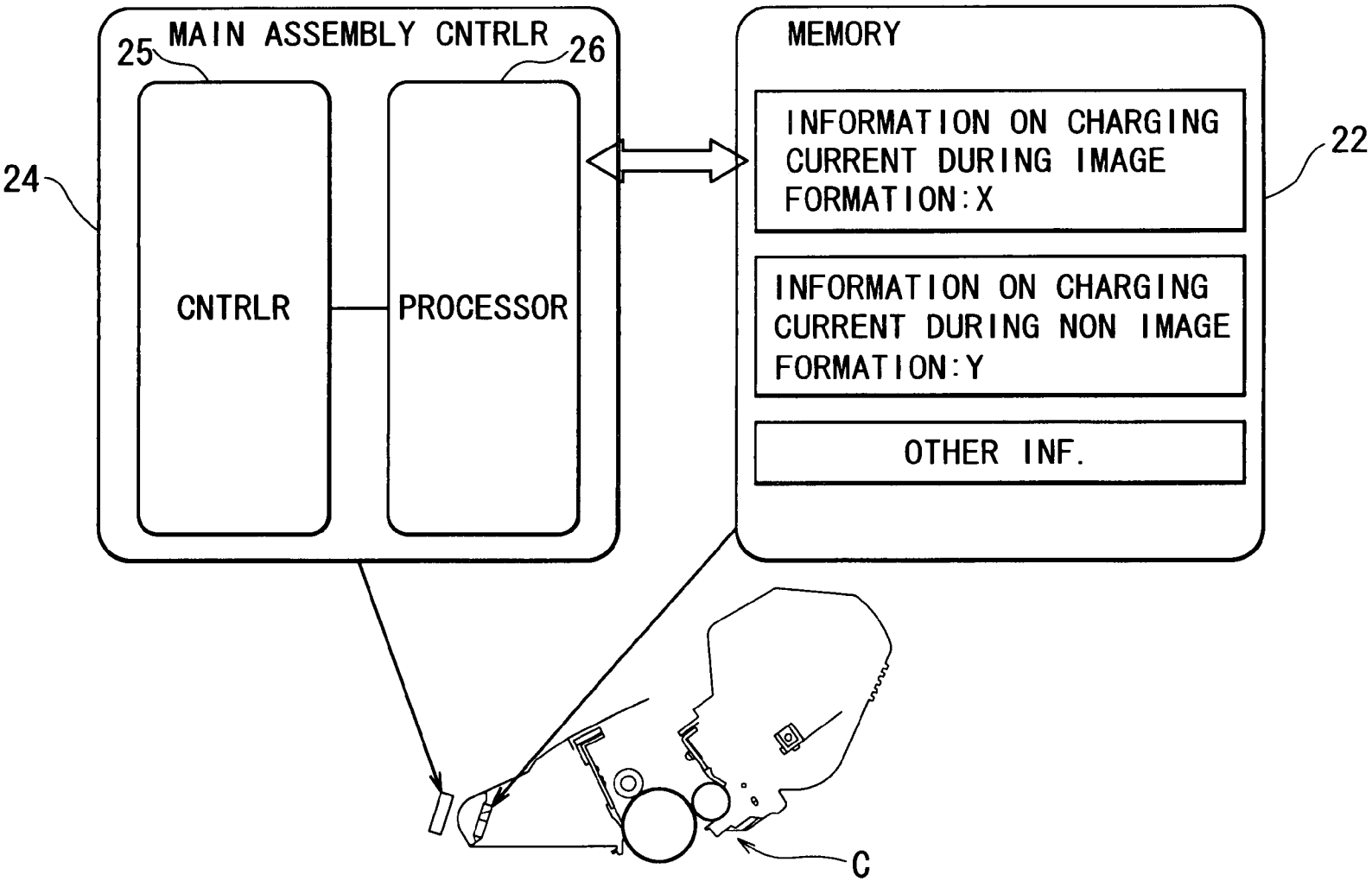
FIG. 5 is a block diagram showing the control portions of the main assembly of the image forming apparatus, and the information in the memory, in the first embodiment of the present invention.

Shown in FIG. 5 are the various data in the memory 22. There are stored various data in the memory 22. In this embodiment, the data to be stored in the memory are at least the data X, which is the value of the charge current to flow while an image is formed, and the data Y, which is the value of the charge current to flow while no image is formed.

Here, the benefits of writing the information regarding the amount of the charge current to flow from the charge roller 2, into the memory 22 of the cartridge C will be described.

There are various rollers which can be used as the charge roller 2 of the cartridge C. Thus, the charge bias applied to the charge roller 2 must be adjusted according to the properties of the roller employed as the charge roller 2. Therefore, the cartridge C in this embodiment is provided with the memory 22, in which the charge current value matching the properties of the charge roller 22 can be stored. The provision of such a memory as the memory 12, in which the above described information is stored, is beneficial in that even if the present roller as the charge roller 12 is replaced with a roller of a different type, the value, in the memory 22, for the amount of the charge current can be rewritten so that the main assembly can read the new value to apply proper charge bias to the replacement roller as the charge roller 22.

The information to be stored in the memory 22 may be the charge current value itself, or coded information which represents charge current value. The charge current value can be converted into one or two bits of data. Therefore, the storage capacity required of the memory 22 when storing the charge current value in the form of a code is much smaller than that required when the charge current value itself is stored. In other words, storing the charge current value, in the form of a code, makes it possible to reduce the storage capacity required of the memory 22. Incidentally, when the charge current value is stored in the form of coded information, the actual charge current values corresponding to the coded information of the charge current values are to be stored in the storage medium portion of the main assembly of an image forming apparatus.

The memory 22 of the cartridge and the control portion 24 of the main assembly are set up so that the above described types of information can be exchanged between the memory 22 and the arithmetic portion 26 of the control portion 24. Calculation is made based on the information from the memory 22 and the information on the main assembly side, and the obtained data are referenced by the controlling portion proper 25.

Figure 6:
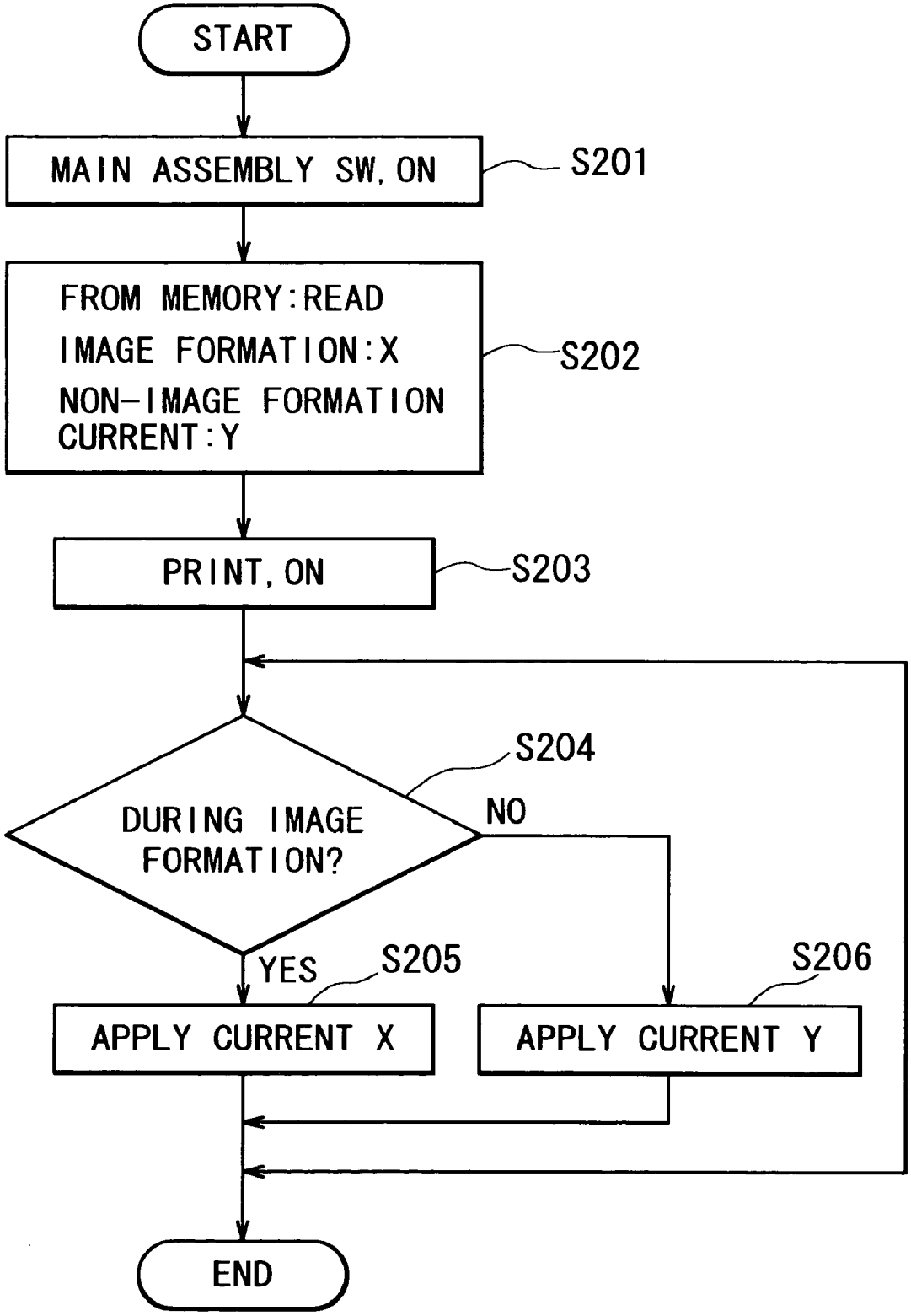
FIG. 6 is a flowchart showing the operation of the image forming apparatus in the first embodiment of the present invention.

Next, referring to FIG. 6, which is a flowchart, the operation of the image forming apparatus in this embodiment will be described.

As the operation of the image forming apparatus is started (Start), each of the following steps (S201–S206) is carried out.

S201: The power source of the main assembly of the image forming apparatus is turned on.

S202: The control portion 24 of the main assembly reads the datum X1, which is the charge current value for the image formation period, and the datum Y1, which is the charge current value for the non-image formation period.

S203: A print-on signal is transmitted from the controlling portion proper 25.

S204: It is determined whether or not the apparatus is in the image formation period.

S205: a charge bias in accordance with the datum X, which is the charge current value for the image formation period, is applied to the charge roller 2 with a predetermined timing.

S206: a charge bias in accordance with the datum Y, which is the charge current value for the non-image formation period, is applied to the charge roller 2 with a predetermined timing.

In other words, the control portion of the main assembly is programmed so that while the apparatus is in the image formation period, it applies to the charge roller 2, a charge bias in accordance with the datum X in the memory 22, whereas when the apparatus is in the non-image formation period, it applies to the charge roller 2, a charge bias in accordance with the datum Y in the memory 22.

A switching signal is transmitted to the charge bias power source 29, shown in FIG. 4, from the controlling portion proper 25, whereby the amount of charge current that is flowing is changed.

This concludes the controlling operation (End).

Figure 7:
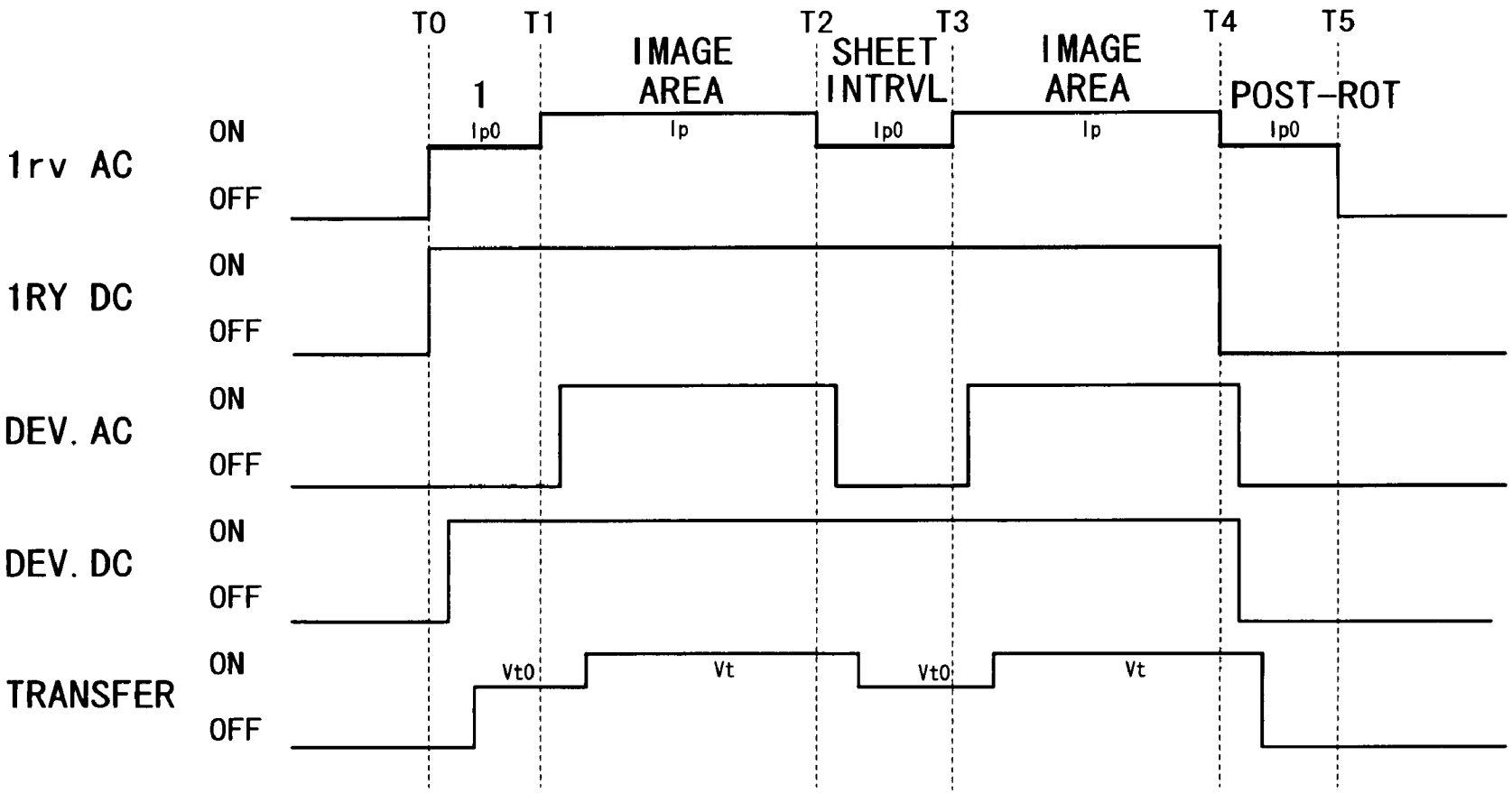
FIG. 7 is a timing chart for the image formation sequence in the first embodiment of the present invention.

Next, referring to FIG. 7 which is a timing chart for the charge current switching sequence, the timing with which the amount by which the charge current (AC voltage in primary charge bias) flows is switched, and the value of the charge current, will be described.

First, the image formation period and non-image formation period, in FIG. 7, will be described. The period between points in time T0 and T1 is the pre-rotation period, in which the image forming apparatus is prepared for an image forming operation. As soon as the pre-rotation period ends, that is, as soon as the image forming apparatus becomes ready for an image forming operation, the period between the points T1 and T2, which is an image formation period, begins. More specifically, this image formation period is the period starting from a point T (in time) at which a recording paper fed into the image forming apparatus to form an image thereon is detected by the top sensor (referential number 30 in FIG. 1) disposed on the upstream side of a photoconductive drum, in terms of the recording paper, to the point T2 (in time), at which the trailing end of the recording paper comes out of the nipping portion between the photoconductive drum and transfer roller. In other words, it is the period in which an image on the photoconductive drum is transferred onto the recording paper, that is, the period from the time at which the trailing end of the recording paper turns off the top sensor, to a predetermined length of time thereafter. The period from the points T2 to T3, which is an recording paper interval, is a period (of a predetermined length) from point T2 to the point T3 (in time) at which the leading end of the next recording paper is detected by the top sensor. The period between the point T4 and the point T5 is a post-rotation period, that is, the period from the point T4 (in time) at which the trailing end of the recording paper comes out of the aforementioned nipping portion, and to the point T5 (in time) which is such a length of time that is necessary, after the point T4, for carrying out the post-image formation process, in which the photoconductive drum is rotated a minimum of one full turn to uniformly reduce the electrical potential of the peripheral surface of the photoconductive drum.

As described above, the timings with which the image formation period and non-image formation period are initiated are set by the point in time at which a recording paper reaches the top sensor. In this embodiment, their timings are set based on the signal from the top sensor. However, in the case of an image forming apparatus which is much faster in image formation speed, the operational timing may be set based on the signal from a recording paper detection sensor (unshown) disposed closer to the feed roller than the top sensor, instead of the signal from the top sensor.

First, the timing with which the AC and DC (−) voltages of the primary charge bias, the AC and DC (−) voltages of the development bias, and the DC (+) voltage of the transfer bias, are applied, will be described. Further, the operational timing will be described by dividing the timing chart into five periods: (1)(2)(3)(4)(5), which can be classified into two groups: image formation periods ((2)(4)) and non-image formation periods ((1)(3)(5)). Here, the operational timings will be described in relation to the timing with which the AC voltage in the primary charge bias is applied. Thus, compared to the point in time at which the AC voltage of the charge bias is turned on in the periods (2) and (4), the point in time at which the AC voltage of the development bias is turned on, and the point in time at which the DC voltage of the transfer bias is turned on, are deviated to the right side, by the lengths which correspond to the order in which they act on the peripheral surface of the photoconductive drum; the later in the image formation process, the further right in the timing chart. However, there is virtually no difference among the lengths of time they are kept on, because they all must be kept on for the length of time necessary for image formation.

First the image formation periods will be described. During the periods (2) and (4) which are image formation periods, and in which no image defect is allowed to occur, such an AC voltage that allows no image defect to occur, that is, such an AC voltage that causes the charge current to flow at a level of 1,600 $\mu$A (1p) in FIG. 7 in this embodiment, is applied. During these periods, the other biases (voltages) are applied at the same time as the AC voltage of the charge bias is applied. In other words, during these periods, a DC voltage of −620 V, which sets the potential level of the photoconductive drum, is applied to the charge roller 2; and the combination of an AC voltage with a peak-to-peak voltage of 1,600 V and a frequency of 2,400 Hz, and a DC voltage of −400 V is applied as the bias for developing a latent image on the photoconductive drum, after the formation of the latent image on the photoconductive drum. This application of the development bias, that is, the combination of the AC and DC voltages is for creating a contrast, in potential level, of roughly 300 V between the exposed points of the portion of the peripheral surface of the photoconductive drum, across which the latent image has been formed through the exposure of the portion to the laser beam modulated with image formation information, and the DC voltage of the development bias, so that toner is adhered to the exposed points (Vd: −150 V). Then, a DC voltage of roughly +1,500 V is applied as the transfer bias to the transfer roller to transfer this toner image, on the photoconductive drum, formed of negatively charged toner particles, onto the recording medium. The above described image formation process is the image forming process carried out during the normal image formation period.

Next, the bias application timing for the non-image formation periods will be described. The non-image formation period means the periods (1) (pre-rotation period), (3) (sheet interval period), and (5) (post-rotation period). The level $l_{p0}$ at which the charge current flows during these periods is indicated by a bold line; such an AC voltage that causes a charge current of 1,400 $\mu$A to flow is applied as the AC voltage of the charge bias, so that during these periods, a smaller amount of charge current flows than during the image formation period. In other words, even during these periods, the charge bias is kept on, but such an AC voltage that causes a smaller amount (level $l_{p0}$ in FIG. 7) of charge current than that which flows during the image formation period, to flow, is applied as the AC voltage of the charge bias; in the timing chart, the level at which the charge current flows during the non-image formation period is slightly lower than that during the image formation period. As will be evident from the above description, during the non-image formation periods which do not affect the quality at which an image is outputted, it does not matter if certain points of the peripheral surface of the photoconductive drum are charged insufficiently enough to produce "sands". Therefore, the charge current level is set as described above. However, even during the non-image formation periods, it is desired that the potential level of the peripheral surface of the photoconductive drum will converge to the potential level equal to the potential level of the DC voltage applied at the same time as the AC voltage, as long as an AC voltage is applied as a part of the charge bias. Therefore, of course, even during the non-image formation periods, the AC voltage applied as the AC voltage of the charge bias is such an AC voltage that is at least twice the starting voltage, in peak-to-peak voltage.

Next, each period will be described in detail. First, the period (1) will be described. This period is the period in which an image forming apparatus is prepared for an actual image forming operation. In this period, therefore, it is logical that such an AC voltage that causes the charge current to flow at a lower level $l_{p0}$ (1,400 $\mu$A) than the level at which the charge current flows during the image formation period, is applied. There are two reasons for applying charging bias during this preparatory period. One is for making the potential level of the peripheral surface of the photoconductive drum smoothly converge to a predetermined value, by applying the DC voltage along with the AC voltage prior to the starting of the actual image forming step. Other is as follows. That is, in order to adjust the transfer bias (+DC) in response to the changes in the ambience so that a proper amount of transfer bias is applied regardless of the ambience, a predetermined amount of bias (+1,000 V in this embodiment) is applied to the photoconductive drum, the potential level of the unexposed points of which is Vd, to adjust the amount of the transfer bias by the current which flows into the photoconductive drum. During the application of this bias, the polarity of the potential of the photoconductive drum reverses, and the peripheral surface of the photoconductive drum is charged to a potential level of roughly +500 V, that is, the difference between (transfer bias +1,000V) and the starting voltage. Therefore, the charge bias is applied to reverse the polarity of the peripheral surface of the photoconductive drum to negative so that the image forming operation will smoothly proceed from the pre-rotation period (non-image formation period) into the image formation period.

In other words, the pre-rotation period is the period in which the potential level of the peripheral surface of the photoconductive drum is made uniform at a predetermined value so that the image formation period can be smoothly started. Thus, during the pre-rotation period, such an AC voltage that makes the charge current flow by the minimum amount necessary to charge the photoconductive drum to a predetermined potential level, is applied in order to reduce the amount of the frictional wear of the photoconductive drum, knowing that at this potential level, certain points of the peripheral surface of the photoconductive drum are charged insufficiently enough to produce "sands". Incidentally, during this period, a DC voltage of 450 V is applied as the development bias. This is for reducing the contrast between the potential level of the photoconductive drum, which is −600 V, and the potential level of the development sleeve, in order to prevent the toner from adhering to the wrong spots of the photoconductive drum, that is, to prevent the toner from being wasted.

Next, the period (3) (sheet interval) which is a non-image formation period will be described. Also in this period, which is unnecessary for image formation per se, such an AC voltage that causes 1,400 $\mu$A of charge current to flow is applied as the AC voltage of the charge bias. The AC voltage applied as a part of the development bias is turned off virtually at the same time as the AC voltage of the charge bias, in order to minimize the amount by which the developmental force is unnecessarily generated. The DC voltage as a part of the development bias is kept on as described before, being set at roughly −600 V, versus the DC voltage of 620 V as a part of the charge bias, in order to make it difficult for the contrast in potential between the development roller and photoconductive drum to generate the developmental force. Also during this period (3), a DC voltage of (predetermined voltage $V_{r0}$ +1,000 V), versus the potential level of the peripheral surface of the photoconductive drum, or roughly −600 V, is applied as the transfer bias. Moreover, this transfer bias is turned on upon arrival of the leading end of the recording medium at the transfer station, being adjusted to a proper level in consideration of the properties (electrical resistance) of the recording paper, in addition to the other factors.

The period (5) is the period in which the photoconductive drum is rectified in potential level after image formation. In other words, all that is necessary to be accomplished in this period is to make the potential level of the photoconductive drum to settle at 0 V, and it is acceptable that certain points of the peripheral surface of the photoconductive drum are charged insufficiently enough to result in the formation of the "sands". The amount of the charge voltage applied during this period is also smaller than that applied during the image formation period; such voltage that causes 1,400 $\mu$A (level $l_{p0}$ in FIG. 7) of charge current to flow is applied. This period is characterized in that by the time this period ends, all the biases will have been turned off one after another. More specifically, first, the AC and DC voltages of the development bias are turned off, and then, the transfer bias is turned off. Lastly, the charge bias is turned off. As described above, the objective to be accomplished in this period is to make the potential level of the photoconductive drum to converge to 0 V. In this period, therefore, the DC voltage of the charge bias is kept off, and the AC voltage of the charge bias is kept at such a level that the interaction of the AC voltage of the charge bias and the AC and DC voltages of the development bias prevents toner from adhering to the photoconductive drum.

To describe in more detail the peak-to-peak voltage level $l_{p0}$ of the AC voltage of the charge bias during this period, until the trailing edge of the portion of the peripheral surface of the photoconductive drum to which the transfer bias has been applied reaches the nipping portion between the photoconductive drum and charge roller, an AC voltage with a peak-to-peak voltage level of $l_{p0}$ is continuously applied to make the potential level of the peripheral surface of the, photoconductive drum to converge to 0 V. In other words, even outside the image formation period, the charge current is necessary. Thus, keeping the peak-to-peak voltage of the AC voltage applied as a part of the charge bias at the lowest level is one of the very important points in extending the service life of a photoconductive drum.

To apply, as the AC voltage of the charge bias, such an AC voltage that causes the smallest amount of charge current necessary for keeping the potential level of a photoconductive drum at a level equivalent to the potential level (−600 V) of the properly charged (unexposed) portion of the photoconductive drum, keeping the contrast between the development bias and potential level of the photoconductive drum at such a level that makes it difficult for toner to adhere to the photoconductive drum, and preventing the unnecessary adhesion of toner to the photoconductive drum, to flow, is another of the very important points in extending the service life of a photoconductive drum.

The above described image formation period corresponds to the period in which a photoconductive drum is in contact with a recording paper and/or an image is being formed on the photoconductive drum. The non-image formation period means the period in which no image is being formed on the photoconductive drum.

As described above, in this embodiment, when an image forming operation proceeds from an image formation period into a non-image formation period, the charge bias is switched, in order to switch the amount of the charge current, making it possible to apply such a charge bias that minimizes the amount of the charge current, in accordance with the properties of a given charge roller, while keeping image quality at a preferable level, extending thereby the service life of a photoconductive drum. According to one of the tests, a photoconductive drum of a certain type, the service life of which in terms of print count was estimated to be 15,000, could produce 18,000 prints, proving the effectiveness of the present invention.

Also in this embodiment, a process cartridge is provided with a memory, and the information regarding the amount of the charge current of the charge roller in the process cartridge is stored in the memory. Therefore, even when the cartridge in an image forming apparatus is replaced with a cartridge different in charge roller properties from the one in the image forming apparatus, it is possible for proper charge bias to be applied based on the information in the memory of the replacement cartridge, making it possible to extend the service life of the photoconductive drum in the image forming apparatus, while maintaining image quality at a preferable level.

Embodiment 2

Next, the second embodiment of the present invention will be described. The image forming apparatus and process cartridge in this embodiment are the same in structure as those in the first embodiment. Therefore, they will not be described here, and only what characterizes this embodiment will be described.

In the first embodiment, the information regarding the properties of the charging means in a given process cartridge, and the amounts, by which charge current is to flow during an image formation period and a non-image formation period, are stored in the memory 22 of the given cartridge, and the information is transmitted to the main assembly of an image forming apparatus to make an image formation period different, in the amount by which the charge current flows, from a non-image formation period, in order to reduce the amount by which the photoconductive drum is frictionally worn (shaved). This embodiment was proposed to further reduce the frictional wear of a photoconductive drum.

The following are the results of the experiments carried out to study the relationship between the total amount of flowing charge current to prevent the formation of the "sands", and the cumulative number of the prints.

Figure 8:
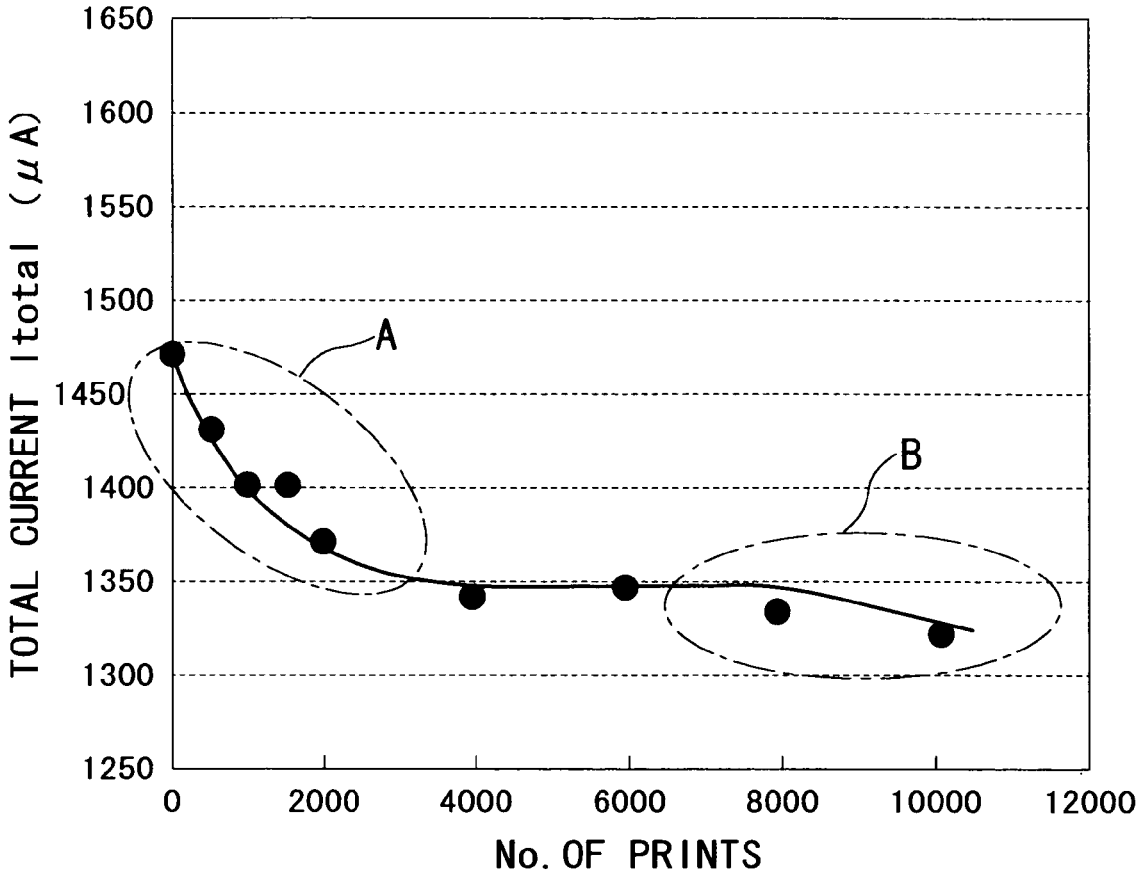
FIG. 8 is a graph showing the relationship between the cumulative number of the copies printed by the image forming apparatus in the second embodiment of the present invention, and the total amount of the charge current.

Referring to FIG. 8, it is evident that the relationship between the cumulative number of prints produced, and the total amount $l_{total}$ of the charge current which is necessary to prevent the formation of the "sands", changes in the ranges A and B in the graph. It is thought to be possible that the sands are formed by the interaction between a charge roller 2 and the thickness of the photoconductive layer of a photoconductive drum 1.

In the range A in the graph, a charge roller is the dominant factor in the formation of the "sands". That is, a charge roller 2 is contaminated with the external additives for toner, reversely charged toner, and paper dust, being thereby changed in charging performance. As a result, the amount by which the charge current flows is reduced.

In the range B in the graph, a photoconductive drum is mainly responsible for the formation the "sands". That is, as a printing operation is repeated, the peripheral surface of the photoconductive drum is gradually shaved, reducing the photoconductive layer of the photoconductive drum in thickness. As the thickness of the photoconductive layer of the photoconductive drum is reduced, the impedance of the photoconductive drum is reduced, increasing thereby the voltage to be applied to charge the photoconductive drum. Therefore, it becomes easier for electrical discharge to occur, reducing thereby the amount of the charge current.

It is evident from the above description that in order to extend the service life of a photoconductive drum without lowering image quality, it is best to set the amount of the charge current to the minimum value, at which no image defect occurs, based on the cumulative print count. What is necessary is to set the amount of the charge current in consideration of the conditions of the charge roller and photoconductive drum. With this arrangement, the frictional wear of a photoconductive drum can be further reduced.

The thickness of the photoconductive layer of a photoconductive drum 1 is affected by the properties of the components of a given process cartridge, and the amount of their usage. In this embodiment, therefore:

(1) A process cartridge C is provided with a memory 22, the amount of the cumulative usage of the cartridge C is calculated based on the cumulative length of time charge bias has been applied, and cumulative length of time the photoconductive drum 1 has been driven, using an arithmetic formulae weighted in terms of these two factors. Hereafter, the amount of the cumulative usage of the cartridge C will be referred to as drum usage data.

(2) The threshold of drum usage data, which is determined by the properties of a photoconductive drum 1 and/or a charge roller 2, the coefficients of the aforementioned arithmetic formulae, and the cumulative amount of the actual drum usage, are stored in the memory 2.

(3) The amount of cumulative cartridge usage is calculated based on the cumulative length of time the charge bias has been applied, which was measured by the main assembly of an image forming apparatus 100, and the cumulative length of time the photoconductive drum 1 has been driven, which also is measured by the main assembly of the image forming apparatus, and if the value obtained by the calculation reaches the threshold stored in the memory, the amount of the charge current is switched. With this arrangement, it is possible to properly charge a photoconductive drum by causing the charge current to flow by the minimum amount necessary to maintain image quality at a preferable level, extending thereby the service life of the photoconductive drum.

Next, referring to FIGS. 9 and 10, the setup, in this embodiment, for controlling the memory will be described.

Figure 9:
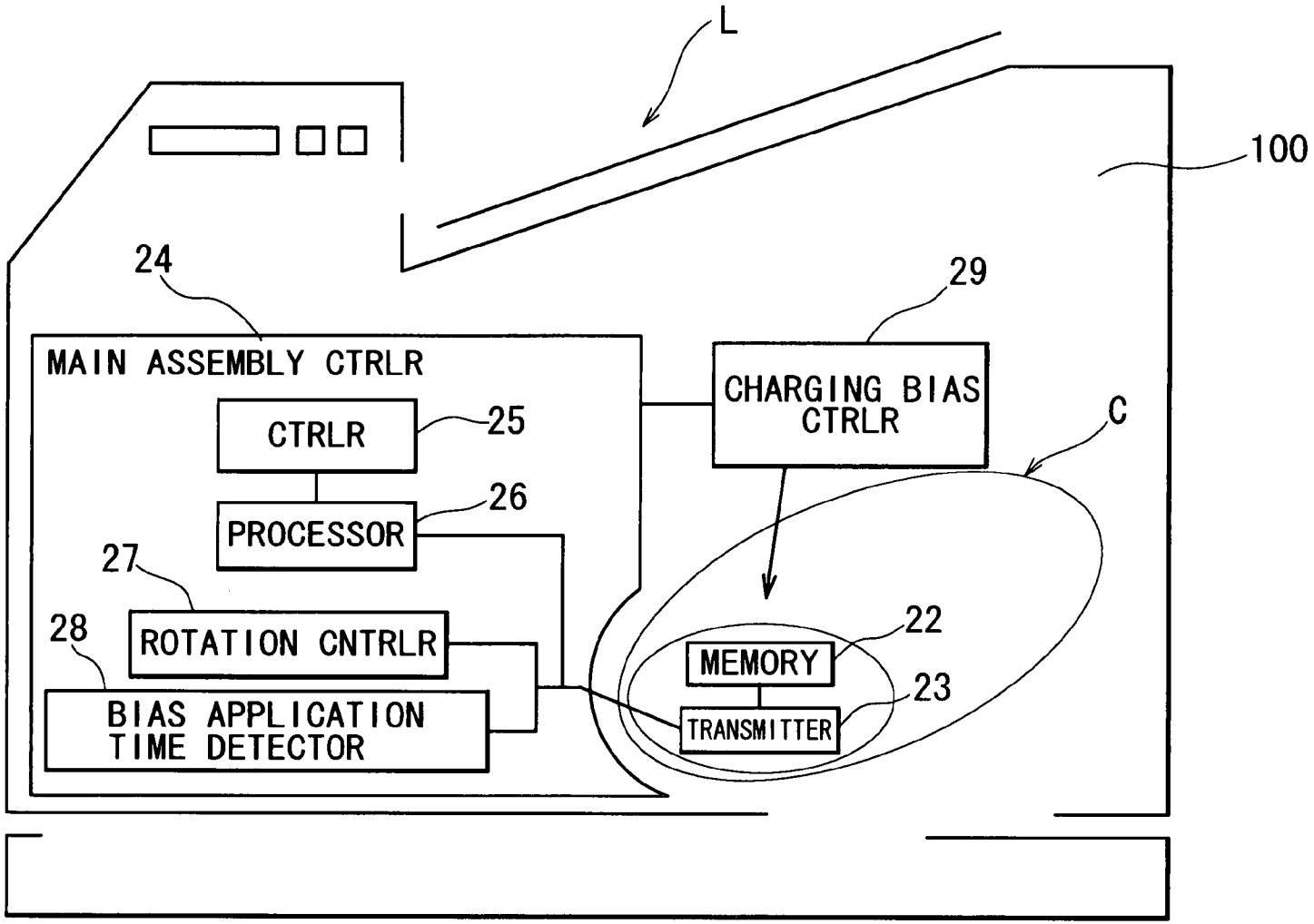
FIG. 9 is a block diagram showing the control portion of the main assembly of the image forming apparatus, and the memory, in the second embodiment of the present invention.

Referring to FIG. 9, the cartridge C is provided with a memory 22 and a transmitting portion 23, whereas the main assembly of the image forming apparatus is provided with a control portion 24 which comprises: a controlling portion proper 25, a arithmetic portion 26, a portion 27 for controlling the photoconductive member rotation, a portion 28 for detecting the length of time the charge bias has been applied, a charge bias power source 29 for applying bias to the charge roller of the cartridge C, etc.

Figure 10:
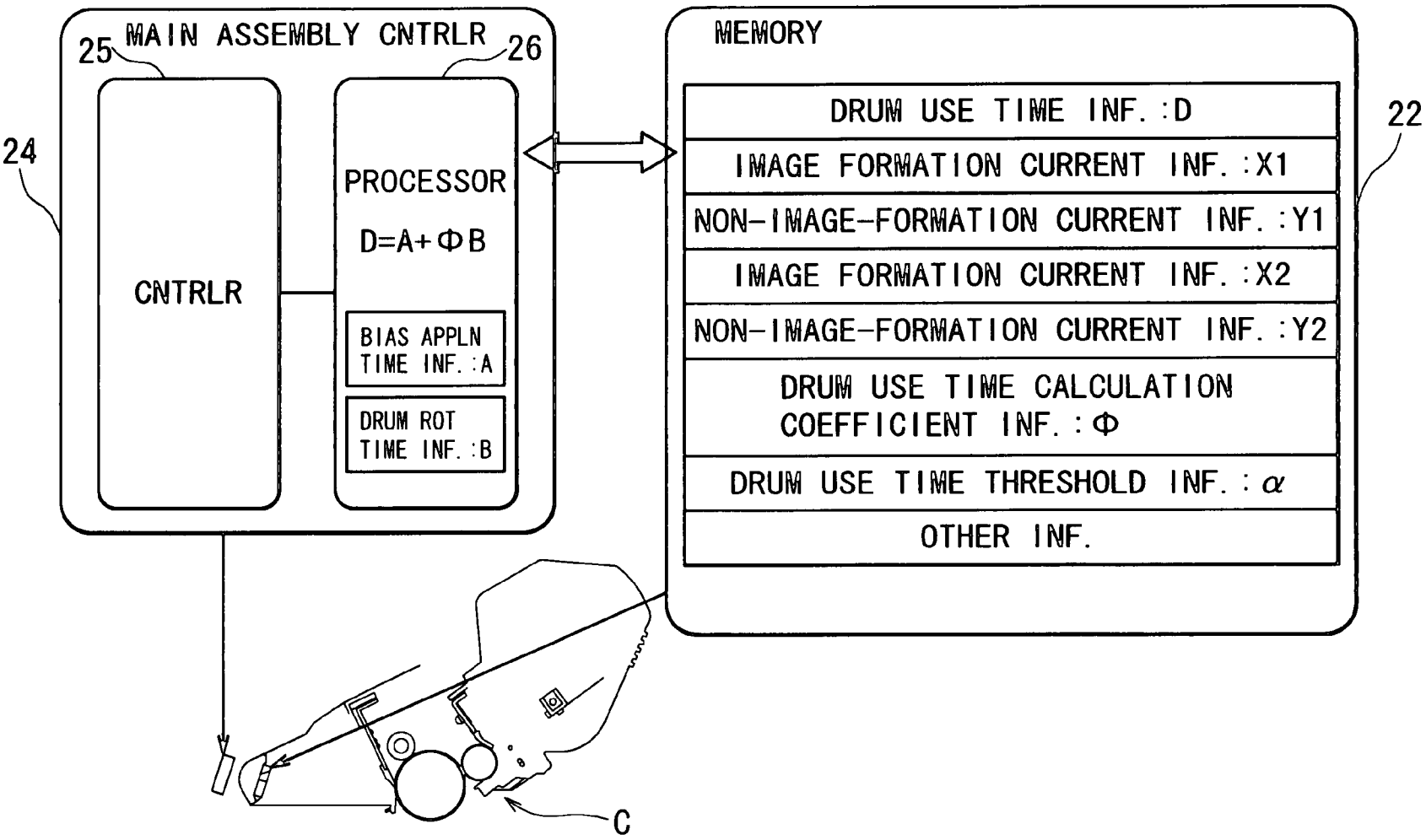
FIG. 10 is a block diagram showing the control portion of the main assembly of the image forming apparatus, and the information in the memory, in the second embodiment of the present invention.

FIG. 10 shows the types of information in the memory 22. There are various types of information stored in the memory 22. In this embodiment, at least the amount D of drum usage, the data (charge current value) X1 for an image formation period, the data (charge current value) X2 for an image formation period, the data (charge current value) Y1 for a non-image formation period, the data (charge current value) Y2 for a non-image formation period, the coefficients $\phi$ for the arithmetic formulae for calculating the amount of the drum usage, and thresholds $\alpha$ for the amount of the drum usage, are to be stored in the memory 22. The thresholds and coefficients are affected by the sensitivity and material of a photoconductive drum 1, the thickness of the photoconductive layer of the photoconductive drum 1 at the time of the drum manufacture, and the properties of a charge roller 2. Therefore, the values which match these properties are written into the memory 22 at the time of cartridge manufacture.

The cartridge C and the main assembly of the image forming apparatus are designed so that the information in the memory 22 can be transmitted or received any time from the control portion 24 of the main assembly to the memory 22, and vice versa. The calculation is made based on these data in the memory 22, and the data are referenced by the controlling portion proper 25.

Next, the method in this embodiment for calculating the drum usage data will be described.

The cumulative amount D of the photoconductive member usage is calculated by the arithmetic portion 26, using a conversion formulae which contains a predetermined coefficient $\alpha$ for weighting ($D=A+B\times\alpha$), based on the cumulative length B of time the photoconductive drum has been rotated by the portion 27 for controlling the photoconductive member rotation, and the cumulative length A of time the charge bias has been applied, which is detected by the portion 27 for detecting the length of time the charge bias has been applied. The value obtained through the above described calculation is added to the cumulative amount of the drum usage which has been stored in the memory.

The calculation for obtaining the drum usage data is to be carried out-each time the driving of a photoconductive drum 1 is stopped.

Figure 11:
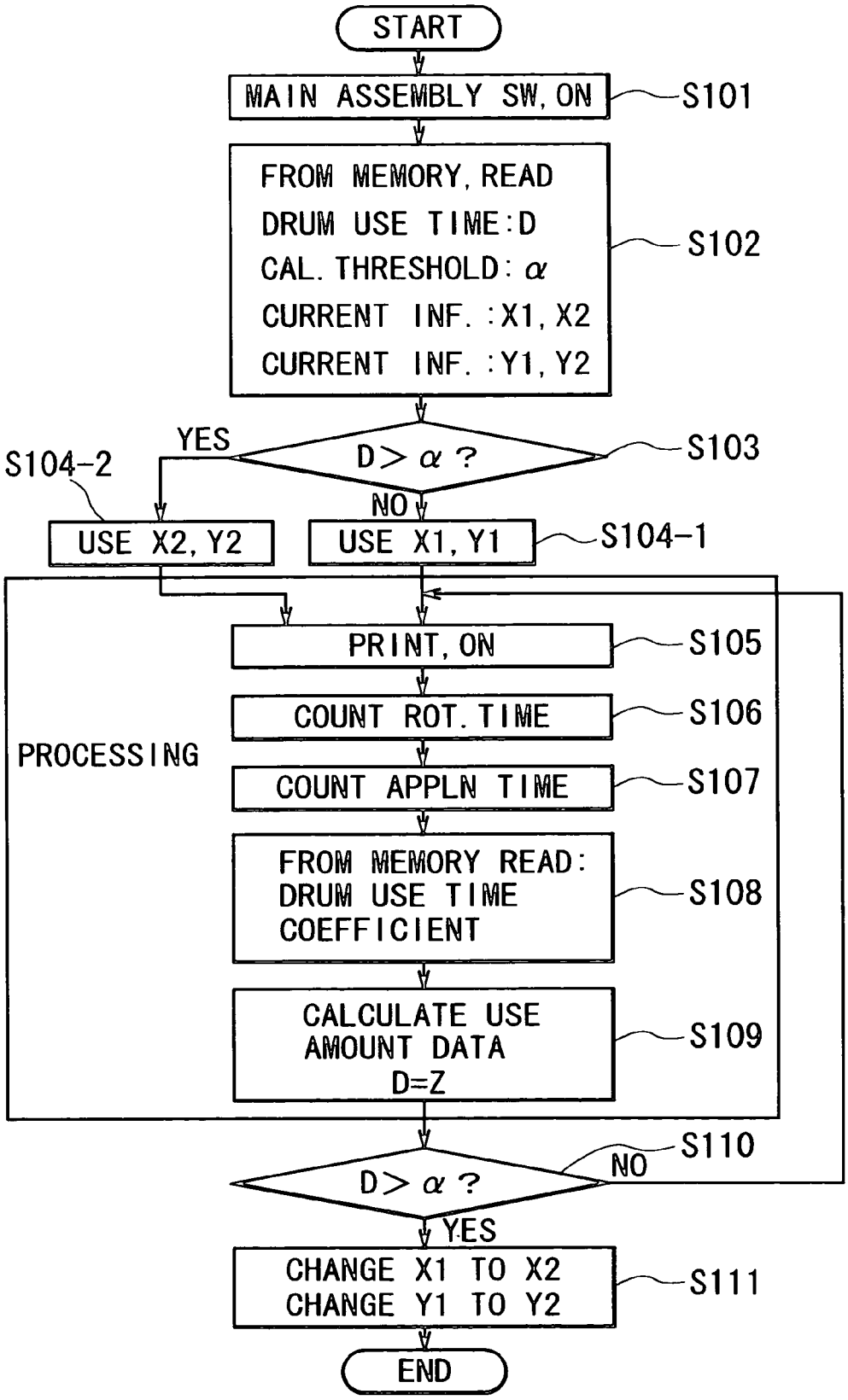
FIG. 11 is a flowchart showing the operation of the image forming apparatus in the second embodiment of the present invention.

Next, referring to FIG. 11 which is a flowchart, the operation of the image forming apparatus in this embodiment will be described.

As the operation of the image forming apparatus is started (Start), each of the following steps (S101–S111) are carried out.

S101: The power source of the main assembly of the image forming apparatus is turned on.

S102: The control portion 24 of the main assembly reads the cumulative amount D of the drum usage stored in the memory 22, threshold $\alpha$ for cumulative length of drum usage, data X1 and X2 regarding the amount of the charge current during an image formation period, and data Y1 and Y2 regarding the amount of the charge current during a non-image formation period, which are in the memory 22.

S103: It is checked whether or not the cumulative amount D of the drum usage is greater than the threshold $\alpha$.

If the cumulative amount D of the drum usage is greater than the threshold $\alpha$, the operation proceeds to a step "YES", that is, S104 2, whereas the cumulative amount D of the drum usage is smaller than the threshold $\alpha$, the operation proceeds to a step "NO", that is, S104-1.

S104: In this case, the cumulative amount D of the drum usage is smaller than the threshold $\alpha$.

Therefore, the charge current values in the data X1 and Y1 are used during an image formation period and a non-image formation period, respectively, in order to cause the charge current to flow by the amount equal to the amount by which the charge current is allowed to flow when a cartridge is used for the first time.

S104-2: In this case, the cumulative amount D of the drum usage is already greater than the threshold $\alpha$. Therefore, the charge current values in the data X2 and Y2 are used during an image formation period and a non-image formation period, respectively, in order to cause the charge current to flow by the amount equal to the amount by which the charge current will be allowed to flow after the switching.

Then, whether the image forming operation proceeds from S104-1 or S104-2, it proceeds to S105, in which a signal to start a printing operation is transmitted from the controlling portion proper 25.

S106: The portion 27 for detecting the length of time of the photoconductive member rotation begins to measure the length of time of the photoconductive member rotation.

S107: The portion 28 for detecting the length of time of the charge bias application begins to measure the length of time of the charge bias application.

S108: The controlling portion proper 25 reads the cumulative amount D of the drum usage, and the coefficient $\phi$ for the arithmetic formulae for calculating the amount D of the drum usage.

S109: The arithmetic portion 26 obtains the drum usage data, that is, the sum of the cumulative length of time the charge bias has been applied, and the cumulative length, weighted with the coefficient $\phi$, of time the photoconductive drum has been rotated, obtained in S107 and S106, respectively.

S110: The controlling portion proper 25 determines whether or not the calculated drum usage data has reached the threshold a in the memory 22. If it is determined "YES", the operation proceeds to S111, whereas if it is determined "NO", the operation returns to S105 to repeat the steps S105–S110.

S111: A switching signal is transmitted to the charge bias power source 29, shown in FIG. 9, from the controlling portion proper 25, changing thereby the amount of the charge current. In this embodiment, as the value of the drum usage data reaches the threshold α, such an AC voltage that has been applied to cause the charge current to flow by 1,600 μA (X1) during an image formation period is switched to such an AC voltage that causes the charge current to flow by 1,400 μA (Y1) during an image formation period, whereas such an AC voltage that has been applied to cause the charge current by 1,400 μA (Y1) during a non-image formation period is left unchanged.

Incidentally, it is possible to reduce the storage capacity required of the memory 22, by storing in the memory 22 the coded charge current data, instead of a large volume of actual charge current data (charge current values themselves) regarding the minimum amount of the charge current for assuring that the charge current flowing during an image formation period will not cause any image defect during an image formation period, while minimizing the frictional wear of a photoconductive drum.

This concludes the controlling operation (End).

Figure 12:
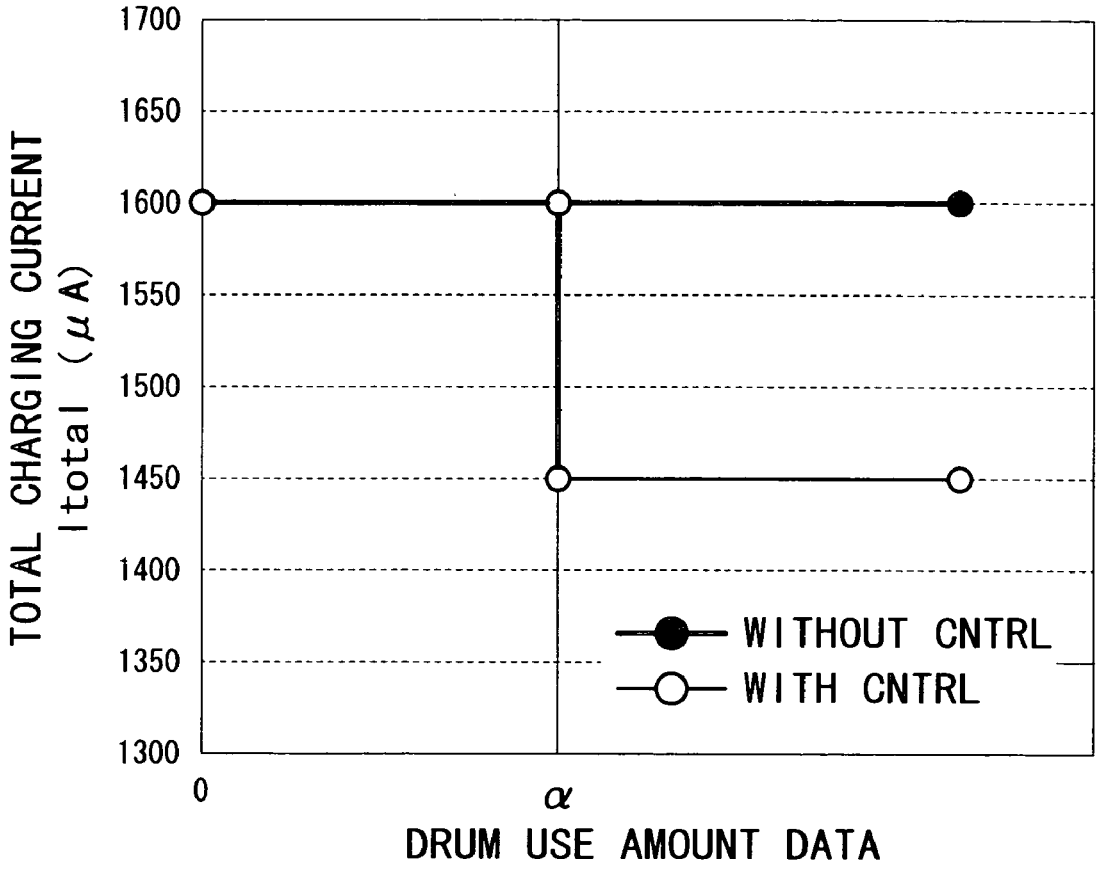
FIG. 12 is a graph showing the relationship between the data regarding photoconductive drum usage, and the amount of the charge current.

As described above, in this embodiment, the AC voltage applied as a part of charge bias is controlled in accordance with the above described flowchart so that the charge current value will follow the solid line in FIG. 12, making it possible to charge a photoconductive drum by causing to flow the minimum amount of charge current necessary to maintain image quality at a preferable level. Therefore, it is possible to extend the service life of a photoconductive drum while maintaining image quality at a preferable level. According to one of the tests, a photoconductive drum of a certain type, the service life of which in terms of print count was estimated to be 15,000, could produce 20,000 prints, proving the effectiveness of the present invention.

In this embodiment, the amount of the charge current is switched only once. However, it may be switched multiple times, that is, in steps, in accordance with the properties of each charge roller. Further, the amount by which the charge current flows may be raised or lowered depending on the condition of each cartridge. Further, in this embodiment, only one threshold is provided for the drum usage data. However, multiple thresholds may be provided.

When multiple thresholds are provided for the drum usage data obtained with the use of the arithmetic formulae, the number of the thresholds (α1, α2 . . . αn) stored in the memory 22 is to made to match the number of the charge current values by which the amount of the charge current is switched. In such a case, the number of the charge current values X for an image formation period, and the number of the charge current values Y for a non-image formation period, which are stored in the memory 22, are to be greater by one than the number of the thresholds a stored in the memory 22. The memory 22 and the main assembly of an image forming apparatus are set up so that these data are transmittable between the memory 22 and the arithmetic portion 26 of the control portion 24 of the main assembly. Calculation is made based on these data, and the data obtained by the calculation is referenced by the controlling portion proper 25.

Incidentally, in the case of a flowchart for an image forming operation in which the charge current is switched multiple times, it is checked first whether or not the amount D of the drum usage is greater than the threshold α1. If it is greater, the amount of the charge current is switched to the second charge current value, and if it is not, the operation goes back to S105 and the steps S105 to S110 are repeated. In other words, the arithmetic process framed by the bold line in FIG. 11 is repeated by the number of times equal to the number of thresholds α (α1–αn). At the end of the repetition, a switching signal is transmitted to the charge bias power source 29, shown in FIG. 9, from the controlling portion proper 25, to switch the amount of the charge current to one of the values in the bias table stored in advance in the controlling portion proper 25.

This concludes the controlling operation (END).

As described above, according to this embodiment, the amount by which the charge current flows is switched between an image formation period and a non-image formation period, in accordance with the condition of a process cartridge (cumulative amount of drum usage) so that the minimum amount of charge current necessary to keep image quality at a preferable level is flowed. Therefore, it is possible to extend the service life of a photoconductive drum, in other words, the service life of a process cartridge, while keeping image quality at a preferable level.

More specifically, according to this embodiment of the present invention, a process cartridge is provided with a storage medium (memory), and such information as the properties of the charging means in the process cartridge and the charge current values in accordance with these properties is stored in the storage medium (memory). Therefore, it is possible to easily extend the service life of a process cartridge while keeping image quality at a preferable level. In other words, according to the present invention, it is possible to provide the combination of a process cartridge, the service life of which can be easily extended while keeping image quality at a preferable level, an image forming apparatus in which such a process cartridge is removably mountable, and an image formation system capable of extending the service life of such a process cartridge.

Also according to this embodiment of the present invention, it is possible to provide a storage medium (memory) mountable in a process cartridge to store the information regarding the amount by which charge current is to flow, and capable of transmitting the information therein to the main assembly of an image forming apparatus.

As described above, according to the above described embodiments of the present invention, the setting for charging a photoconductive drum during an image formation period is made different from that during a period other than an image formation period, making it possible to reduce the shaving of a photoconductive drum without effecting an image defect.

More specifically, a controlling means is provided for changing the amount, by which the charge current is to flow, between an image formation period and a period other than an image formation period, based on the information stored in the storage medium (memory) of a process cartridge, making it possible to set the amounts, by which charge current is to flow during an image formation period and a non-image formation period, to the minimum values necessary to keep image quality at a preferable level, in accordance with the information regarding the cartridge properties, that is, the properties of the charging means in the cartridge. Therefore, it is possible to always form an excellent image while minimizing the frictional wear (shaving) of the photoconductive member. In other words, it is possible to extend the service life of a photoconductive member without changing the material for a photoconductive drum, and the thickness of the photoconductive layer of the photoconductive drum. This means that according to the embodiments of the present invention, a photoconductive member can be reduced in the thickness of its photoconductive layer, while providing the photoconductive member with the same specifications (service life of same length) as those of a photoconductive member in accordance with the conventional arts, making it possible to not only reduce the cost of a photoconductive drum, but also, to form a sharper latent image which effects a better image than an image formed with the use of a photoconductive member in accordance with the conventional arts.

In the above described embodiments, the information to be stored in the memory of a cartridge was the values for the charge current to flow during an image formation period and a non-image formation period. However, the information to be stored in the memory does not need to be limited to the above described one. For example, the values for the charge voltage instead of the values for the charge current may be stored, which is obvious.

Further, the above described information may be stored in code in the storage medium. By coding the above described information, the size of the region of the storage memory required for storing the above described information can be substantially reduced, making it possible for the storage medium to store the information other than the above described, and therefore, it is possible to execute a wider range of control.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus to which a process cartridge is detachably mountable, said process cartridge comprising an image bearing member, a charging member configured and positioned to electrically charge the image bearing member, and a memory medium having a memory area configured to store information relating to a charging current to be applied to the image bearing member by the charging member for a non-image-formation period in which no image is formed on the image bearing member and in which the image bearing member operates to perform an image formation operation, said apparatus comprising:

a control unit configured to control a voltage to be applied to the charging member, wherein the control unit is configured to switch the voltage in accordance with the information relating to the charging current stored in the memory medium.

2. An apparatus according to claim 1, wherein the memory medium has a second memory area configured to store the information relating to the charging current to be applied to the image bearing member by the charging member for an image-formation period during which the image bearing member operates to perform the image formation operation and during which an image is formed on the image bearing member.

3. An apparatus according to claim 2, wherein said control unit switches the voltage to be applied to the charging member depending on whether said apparatus is in the image-formation period or in the non-image-formation period, in accordance with the stored information relating to the charging current for the image-formation period and the stored information relating to the charging current for the non-image-formation period.

4. An apparatus according to claim 2, wherein the memory medium further includes a third memory area configured to store information relating to a usage amount of the image bearing member, wherein said control unit switches the voltage in accordance with the stored information relating to the charging current for the image-formation period, the stored information relating to the charging current for the non-image-formation period and the stored information relating to the usage amount of the image bearing member.

5. An apparatus according to claim 2, wherein the information relating to the charging current for the non-image-formation period includes information representing voltages to be applied to the charging member, and the information relating to the charging current for the image-formation period includes information representing a voltage to be applied to the charging member, and wherein the information relating to the charging current for the non-image-formation period represents a value that is smaller than the value represented by the information relating to the charging current for the image-formation period.

6. A process cartridge detachably mountable to an image forming apparatus, said process cartridge comprising:

an image bearing member;

a charging member configured and positioned to electrically charge said image bearing member;

a memory medium configured to store information relating to said process cartridge, said memory medium having a memory area configured to store information relating to a charging current to be applied to said image bearing member by said charging member for a non-image-formation period in which no image is formed on said image bearing member and in which said image bearing member operates to perform an image formation operation.

7. A process cartridge according to claim 6, wherein said memory medium has a second memory area configured to store information relating to a charging current to be applied to said image bearing member by said charging member for an image-formation period during which said image bearing member operates to perform the image formation operation and during which an image is formed on said image bearing member.

8. A process cartridge according to claim 6, wherein said memory medium further includes a third memory area configured to store information relating to a usage amount of said image bearing member.

9. A process cartridge according to claim 7, wherein the information relating to the charging current for the non-image-formation period includes information representing voltages to be applied to said charging member, and the information relating to the charging current for the image-formation period includes information representing a voltage to be applied to said charging member, and wherein the information relating to the charging current for the non-image-formation period represents a value that is smaller than the value represented by the information relating to the charging current for the image-formation period.

10. A memory medium for a cartridge detachably mountable to an image forming apparatus, the cartridge including an image bearing member and a charging member configured to electrically charge the image bearing member, said memory medium comprising a memory area configured to store information relating to a charging current to be applied to the image bearing member by the charging member for a non-image-formation period in which no image is formed on the image bearing member and in which the image bearing member operates to perform an image formation operation.

11. A memory medium according to claim 10, further comprising a second memory area configured to store information relating to a charging current to be applied to the image bearing member by the charging member for an image-formation period during which the image bearing member operates to perform the image formation operation and during which an image is formed on the image bearing member.

12. A memory medium according to claim 11, further comprising a third memory area configured to store information relating to a usage amount of the image bearing member.

13. A memory medium according to claim 11, wherein the information relating to the charging current for the non-image-formation period includes information representing a voltage to be applied to the charging member, and the information relating to the charging current for the image-formation period includes information representing a voltage to be applied to the charging member, and wherein the information relating to the charging current to be applied to the image bearing member by the charging member for the non-image-formation period represents a value that is smaller than a value represented by the information relating to the charging current to be applied to the image bearing member by the charging member for the image-formation period.

14. An image forming system for an image forming apparatus comprising a main assembly and a cartridge, wherein the image forming apparatus contains a part of process means for forming an image, wherein said system comprises:

a memory medium provided in the cartridge, said memory medium including a memory area configured to store information relating to a charging current to be applied to an image bearing member of the cartridge for a non-image-formation period during which no image is formed on the image bearing member and in which the image bearing member operates to perform an image formation operation; and a control unit configured to switch a voltage to be supplied to a charging member that charges the image bearing member with the charging current in accordance with the information stored in said memory medium.

15. An image forming system according to claim 14, wherein said memory medium has a second memory area configured to store information relating to a charging current to be applied to the image bearing member of the cartridge for an image-formation period during which the image bearing member operates to perform the image formation operation and during which an image is formed on the image bearing member.

16. An image forming system according to claim 15, wherein said memory medium further includes a third memory area configured to store information relating to a usage amount of the image bearing member, wherein said control unit switches the voltage applied to the charging member in accordance with the stored information relating to the charging current for the image-formation period, the stored information relating to the charging current for the non-image-formation period and the stored information relating to the usage amount of the image bearing member.

17. An image forming system according to claim 15, wherein the information relating to the charging current to be applied to the image bearing member for the non-image-formation period includes information representing a voltage to be applied to the charging member, and the information relating to the charging current to be applied to the image bearing member for the image-formation period includes information representing a voltage to be applied to the charging member, and wherein the information relating to the charging current for the non-image-formation period represents a value that is smaller than the value represented by the information relating to the charging current for the image-formation period.

* * * * *

UNITED STATES PATENT AND TRADEMARK OFFICE

CERTIFICATE OF CORRECTION

PATENT NO. : 6,970,661 B2
APPLICATION NO. : 10/702613
DATED : November 29, 2005
INVENTOR(S) : Shoji It is certified that error appears in the above-identified patent and that said Letters Patent is hereby corrected as shown below:

COLUMN 1
Line 11, “facsimileing” should read --facsimile--.

COLUMN 2
Line 17, “may increased” should read --may be increased--.

COLUMN 6
Line 53, “point reduced” should read --point is reduced--.

COLUMN 9
Line 27, “correspond” should read --corresponds--.

COLUMN 11
Line 63, “an” should read --a--.

COLUMN 16
Line 62, “formulae” should read --formula--.

COLUMN 17
Line 1, “formulae,” should read --formula,--.
Line 58, “formulae” should read --formula--.

COLUMN 18
Line 2, “out-each” should read --out each--.
Line 67, “threshold a” should read --threshold $\propto$--.

COLUMN 19
Line 56, “thresholds a” should read --thresholds $\propto$--.

COLUMN 20
Line 28, “is” (first occurrence) should read --are--.

COLUMN 22
Line 26, “member,” should read --member; and--.

UNITED STATES PATENT AND TRADEMARK OFFICE

CERTIFICATE OF CORRECTION

PATENT NO. : 6,970,661 B2
APPLICATION NO. : 10/702613
DATED : November 29, 2005
INVENTOR(S) : Shoji It is certified that error appears in the above-identified patent and that said Letters Patent is hereby corrected as shown below:

COLUMN 24
Line 23, "period" should read --period,--.

Signed and Sealed this

Twenty-second Day of August, 2006

JON W. DUDAS
*Director of the United States Patent and Trademark Office*